US005272489A

United States Patent [19]

Kobayashi et al.

[11] Patent Number: 5,272,489

[45] Date of Patent: Dec. 21, 1993

[54] THERMAL HEAD AND ELECTRONIC APPARATUS USING THE SAME

[75] Inventors: Hiroki Kobayashi; Kunio Motoyama; Shigeo Ota, all of Kyoto, Japan

[73] Assignee: Rohm Co., Ltd., Kyoto, Japan

[21] Appl. No.: 913,913

[22] Filed: Jul. 17, 1992

[30] Foreign Application Priority Data

Jul. 23, 1991 [JP] Japan ..... 3-182163

[51] Int. Cl.[5] ..... B41J 2/335

[52] U.S. Cl. ..... 346/76 PH

[58] Field of Search ..... 346/76 PH; 358/296

[56] References Cited

U.S. PATENT DOCUMENTS 4,862,193 8/1989 Hattori et al. ..... 346/76 PH 4,907,015 3/1990 Kaneko et al. ..... 346/76 PH 5,014,135 5/1991 Ijuin et al. ..... 346/76 PH

*Primary Examiner*—Benjamin R. Fuller

*Assistant Examiner*—Huan Tran

*Attorney, Agent, or Firm*—Oliff & Berridge

[57] ABSTRACT

In order to obtain a thermal head for a single power source drive with a good print efficiency and capable of performing high speed printing, semiconductor driver elements having a small on-resistance and a small output saturation voltage $V_{CE}$ are used, and in order to reduce a voltage drop $V_{lead}$ of each separate electrode, an inorganic gold paste as a separate electrode material is used to form a thick layer part. An electronic apparatus using the thermal head is also disclosed.

11 Claims, 4 Drawing Sheets

SLT = 13 ms
P = 2.5 Kgf
U set = 5.0 V

THERMAL HEAD AND ELECTRONIC APPARATUS USING THE SAME

BACKGROUND OF THE INVENTION i) Field of the Invention

The present invention relates to a thermal head, and more particularly to a thermal head for a low voltage drive, and an electronic apparatus such as a printer, a word processor, a facsimile machine, a plotter or the like using the thermal head.

ii) Description of the Related Arts

Generally, in a thermal head, a common electrode conductor and separate electrode conductors are formed on an insulating substrate, and a plurality of heating resistors are connected to the common electrode conductor and the separate electrode conductors. Further, semiconductor driver IC elements for separately driving the heating resistors are also formed on the substrate. In the thermal head of this kind, conventionally, two power source systems to supply 5 V for driving a logical system and 12 to 24 V for driving heating resistors are provided.

In this conventional thermal head, usually, since two power source systems are used, the size of the thermal head is enlarged and its fabrication cost is increased. Also, it is difficult to carry out battery driving. Further, in another conventional thermal head in which low voltage driving is enabled by varying the resistance values, an output saturation voltage of the semiconductor driver IC elements is large and printing efficiency is low. Hence, life of a cell is short and the recording speed can not be raised.

SUMMARY OF THE INVENTION

It is therefore an object of the present invention to provide a thermal head for a single power source drive in view of the aforementioned problems of the prior art, which is capable of performing high speed driving with high print efficiency.

It is another object of the present invention to provide a printer including a thermal head for a single power source drive in view of the aforementioned problems of the prior art, which is capable of performing high speed driving with high print efficiency.

In accordance with one aspect of the present invention, there is provided a thermal head for use in an electronic apparatus such a printer, a word processor, a facsimile machine or a plotter, comprising a glaze layer formed on an insulating substrate; a common electrode and at least two separate electrodes formed on the glaze layer; at least two heating resistors extended between the common electrode and the separate electrodes; and at least two semiconductor driver elements for driving the heating resistors, each semiconductor driver element having a small on-resistance and a small output saturation voltage.

In accordance with another aspect of the present invention, there is provided a printer comprising means for feeding a document; means for supplying a paper to be printed on; an image sensor for picking up a pattern of the document and outputting electric signals; a thermal head for heating in order to print on the basis of the electric signals output from the image sensor; and means for supplying an ink ribbon, the thermal head having the same structure as described above.

In order to reduce the on-resistance of the semiconductor driver element, it is considered to enlarge a source side area of the semiconductor driver element.

In the thermal head according to the present invention, in order to reduce the electric resistance of the entire thermal head, the thickness of the common electrode is increased. Hence, by enlarging the source side areas of the semiconductor driver elements and increasing the thickness of the common electrode, the object of the present invention can be more remarkably achieved.

Further, in order to improve the head radiation efficiency, the predetermined parts of both the separate electrodes and the common electrode from the heating part of the thermal head are formed so as to be thin.

In the thermal head, the on-resistance of the semiconductor driver elements is small and the output saturation voltage is far smaller than the conventional thermal head. Accordingly, the voltage to be applied to the heating resistors is increased so the resistance value can be increased. Hence, the consumption current of the heating resistors becomes small. Further, the applying time of the current can be shortened, and thus the life of a cell can be prolonged.

Further, by reducing the on-resistance of the semiconductor driver elements and increasing the thickness of the separate electrodes, the electrical resistance of the entire thermal head can be remarkably reduced. Also, by thinning the thickness of the predetermined ranges of the common electrode and the separate electrodes from the heating part of the thermal head, the heat radiation efficiency of the heating part is largely improved, and thus the head radiation efficiency of the whole thermal head can be largely improved while the heat radiation resistance of the whole thermal head can be decreased. Hence, by these multiplied effects, the power consumption can be decreased and the current applying time can be reduced. As a result, the life of the cell can be prolonged.

Therefore, a printer including this thermal head has advantages such as a small number of cell exchange times and the like.

BRIEF DESCRIPTION OF THE DRAWINGS

The objects, features and advantages of the present invention will become more apparent from the consideration of the following detailed description, taken in conjunction with the accompanying drawings, in which.

DESCRIPTION OF THE PREFERRED EMBODIMENTS

Figure 1:
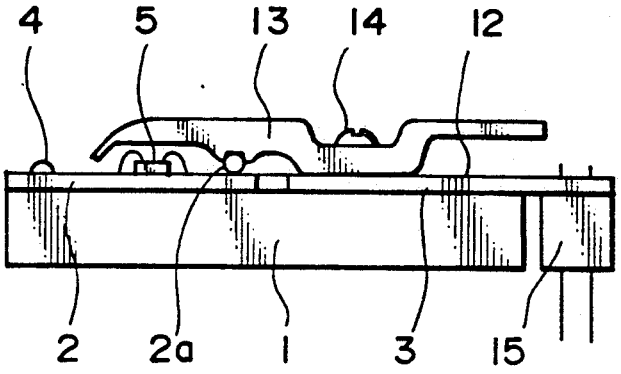
FIG. 1 is a side view of a thermal head according to the present invention.
Figure 2:
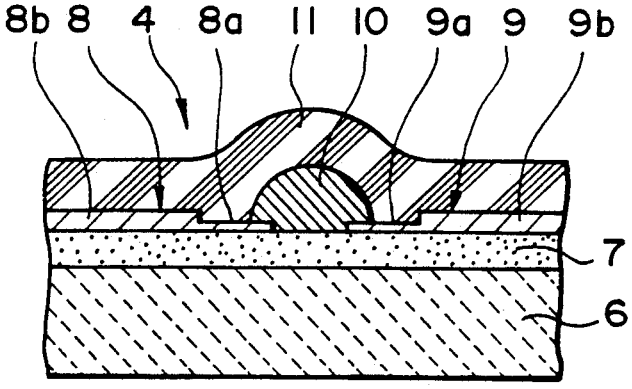
FIG. 2 is a cross sectional view of a heating part of the thermal head shown in FIG. 1.
Figure 3:
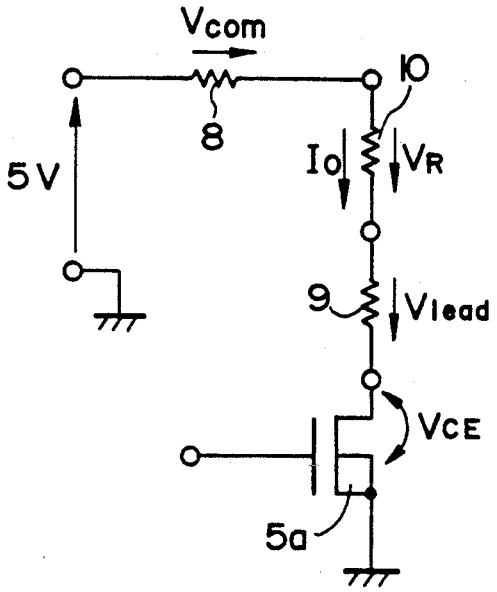
FIG. 3 is a circuit diagram of an equivalent circuit of a driving system of one heating resistor of the thermal head shown in FIG. 1.

Referring now to the drawings, wherein like reference characters designate like or corresponding parts throughout the views and thus the repeated description thereof can be omitted for brevity, there is shown in FIGS. 1 to 3 one embodiment of a thermal head for use in an electronic apparatus such as a printer, a word processor, a facsimile machine, a plotter or the like according to the present invention.

FIG. 1 is a side view of the thermal head and FIG. 2 is a cross section of a heating part of the thermal head shown in FIG. 1. The thermal head is provided with a radiation plate 1, a thermal head substrate 2 and an auxiliary substrate 3, the latter two being formed on the former. On the thermal head substrate 2, a heating part 4 is formed and a driver IC 5 is mounted. As shown in FIG. 2, in the heating part 4, a glaze layer 7 is formed on an upper surface of an insulating substrate 6 such as an alumina substrate, a common electrode conductor 8 and separate electrode conductors 9 are formed on the surface of the glaze layer 7. A plurality of heating resistors 10 (only one is shown in FIG. 2) are formed on the glaze layer 7 so as to extend between the common electrode conductor 8 and the separate electrode conductors 9. The heating resistors 10 are separately driven by the driver IC or ICs 5. The surface of the glaze layer 7, the common electrode conductor 8, the separate electrode conductors 9 and the heating resistors 10 are covered by a protecting film layer 11 to form the heating part 4.

On the other hand, on the upper surface of the auxiliary substrate 3, a flexible circuit substrate 12 having a wiring pattern is mounted. A front terminal part of the flexible circuit substrate 12 is contacted under pressure with a rear terminal part of an electrode conductor part of the thermal head substrate 2 by a presser cover 13 and a contact member 2a interposed therebetween. The presser cover 13, the flexible circuit substrate 12 and auxiliary substrate 3 are secured to the radiation plate 1 by a screw 14 so as to integrate these members. A connector 15 is mounted to the read ends of the flexible circuit substrate 12 and the auxiliary substrate 3. The pressure contact between the terminal parts of the flexible circuit substrate 12 and the thermal head substrate 2 is performed by pressing the overlapped parts of the terminal parts from the top by using silicone rubber, and by this pressure contact, both the terminals can be connected.

In the thermal head of this embodiment, as the feature, an inorganic gold paste as a material of the separate electrode conductors 9 is used so as to increase the film thickness to enlarge the cross section and thus to reduce the lead resistance. In this embodiment, the film thickness is determined to at least 1.8 μm. However, near the heating body, the film thickness is kept thin by using an organic gold paste in order to reduce the radiation heat from the electrode. Further, as the feature of this thermal head, a semiconductor driver element having a small on-resistance and a small output saturation voltage (a small voltage drop) compared with a conventional driver element is used as each driver IC. Also, in this embodiment, in order to reduce the on-resistance of the driver IC, the area of the source side is enlarged. More specifically, while an on-resistance of a conventional driver IC is 20 to 16Ω, the on-resistance of a the driver IC is determined to be at most 7Ω according to the present invention.

More specifically, as shown in FIG. 2, the separate electrode conductor 9 is composed of a thin film part 9a and a thick film part 9b. Similarly, the common electrode conductor 8 is composed of a thin film part 8a and a thick film part 8b. Usually, the heating resistor 10 possesses a width (a length in the transverse direction in FIG. 2) of approximately 240 μm, and the thin film part 9a of the separate electrode conductor 9 has a length of approximately 1.0 to 2.0 mm from the heating resistor 10 and a thickness of approximately 0.6 to 0.8 μm. The thick film part 9b of the separate electrode conductor 9 has a thickness of approximately 1.8 μm. In this case, the thin film part 8a of the common electrode conductor 8 has a fixed length of approximately 0.5 mm from the heating resistor 10 and a thickness of approximately 0.6 to 0.8 μm, and the thin film part 9a of the separate electrode conductor 9 can be changed depending on the kind of a thermal print head to be produced.

As described above, the thick film part 9b of the separate electrode conductor 9 as a lead electrode has a thickness of at least 1.8 μm and the thin film part 9a of the separate electrode conductor 9 is formed near the heating resistor 10, which are the features of this embodiment. By providing the thick film part 9b, the resistance of the separated electrode conductor 9 is reduced, and by providing the thin film part 9a, the heat radiation efficiency of the heating resistor 10 is improved. Hence, by the electric resistance reduction of the separate electrode conductor 9 as the lead electrode and the heat radiation efficiency improvement of the heating resistor 10, an applying time of a cell becomes short and a power consumption becomes small. As a result, the life of the cell is prolonged.

Further, in this embodiment, in order to readily form the thick film part 9b of the separate electrode conductor 9, the inorganic gold paste is used in this part, and in turn, in order to readily form the thin film part 9a, the organic gold paste is used near this part. The organic gold paste is suitable for forming a thin film and on the contrary, the inorganic gold paste is suited for the formation of a relatively thick film. In this embodiment, the common electrode conductor 8 can be formed by a usual method. That is, first, a thin film pattern is formed and then the thick film part 8b is formed by two to three lamination operations in order to improve the strength of the electrode body and the like (the not laminated part becomes the thin film part 8a).

In FIG. 3, there is shown an equivalent circuit of a driving system of one heating resistor in the thermal head according to the present invention. In this case, $V_{com}$, $V_R$, $V_{lead}$, $V_{CE}$ and $I_O$ indicate a voltage drop of the common electrode conductor 8, a voltage of the heating resistor 10, a voltage drop of the separate electrode conductor 9, an output saturation voltage of a semiconductor driver element 5a and a current of a separate resistor, respectively. These values in a conventional system including a thermal driver for a 24 V system drive power source and resistors having a resistance of 45Ω for a 5 V system drive and a present system including a thermal driver for a single 5 V system drive were compared to obtain the results as shown in the following table.

| Head type | $V_R$ (V) | $V_{CE}$ (V) | $V_{lead}$ (V) | $V_{com}$ (V) | $I_o$ (mA) | Head R value (Ω) |
|---|---|---|---|---|---|---|
| Conventional | 3.18 | 1.14 | 0.14 | 0.54 | 70.7 | 45 |
| Present Invention | 3.98 | 0.43 | 0.12 | 0.47 | 61.2 | 65 |

Figure 4:
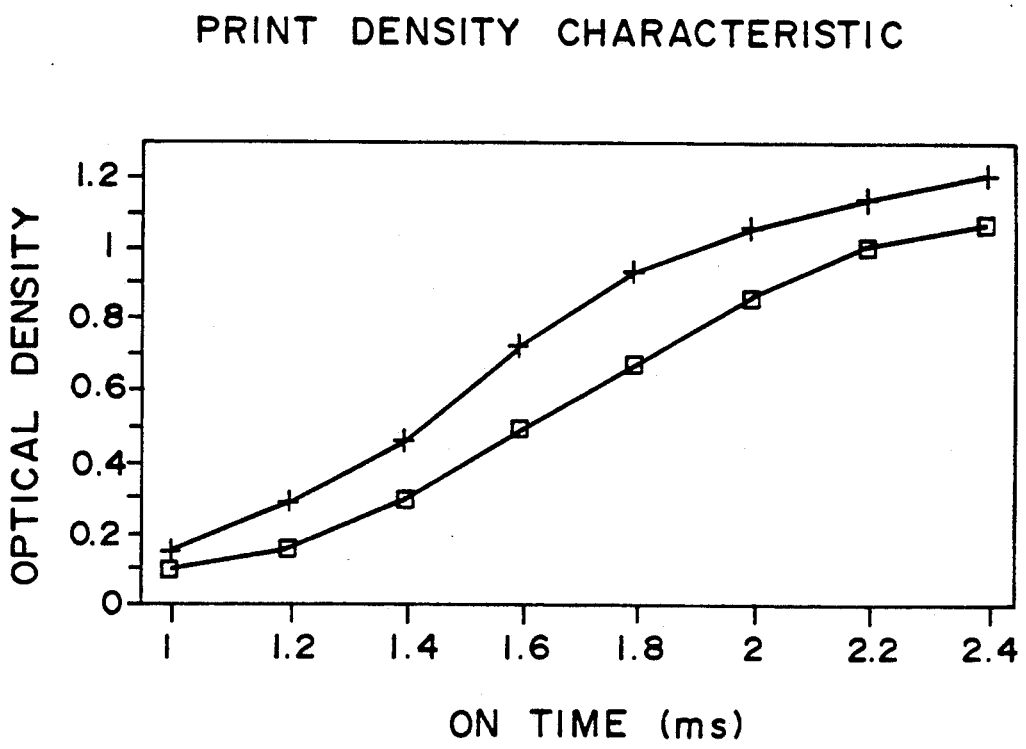
FIG. 4 is a graphical representation illustrating an on time-print density characteristic of the thermal head shown in FIG. 1 in comparison with a conventional thermal head.

Further, an on time-a print density characteristic of a conventional system including the heating part having a resistance of 45Ω and a present system including the heating part having a resistance of 65Ω was measured under conditions such as SLT=13 ms, P pressure=2.5 Kgf and Uset=5.0 V to obtain the results shown in FIG. 4. In FIG. 4, □ indicates the conventional system and + indicates the present system. As is apparent from FIG. 4, it is readily understood that concerning the print efficiency, it is raised by approximately 40% in the present system compared with the conventional system.

As described above, according to the present invention, for example, by charging the on-resistance of the semiconductor driver element to 7Ω from 16Ω in the conventional value, the output saturation voltage is reduced to approximately 50%, and hence the voltage to be applied to the heating part can be increased to thereby increase the resistance value of the heating part to approximately 1.5 times. As a result, the consumption current of the heating resistor can be reduced, and the high print efficiency can be obtained by the single power source. Further, the high speed printing can be carried out, and the long life of the battery can be achieved. Furthermore, a miniaturized, light weight and a low production cost printer can be realized.

Figure 5:
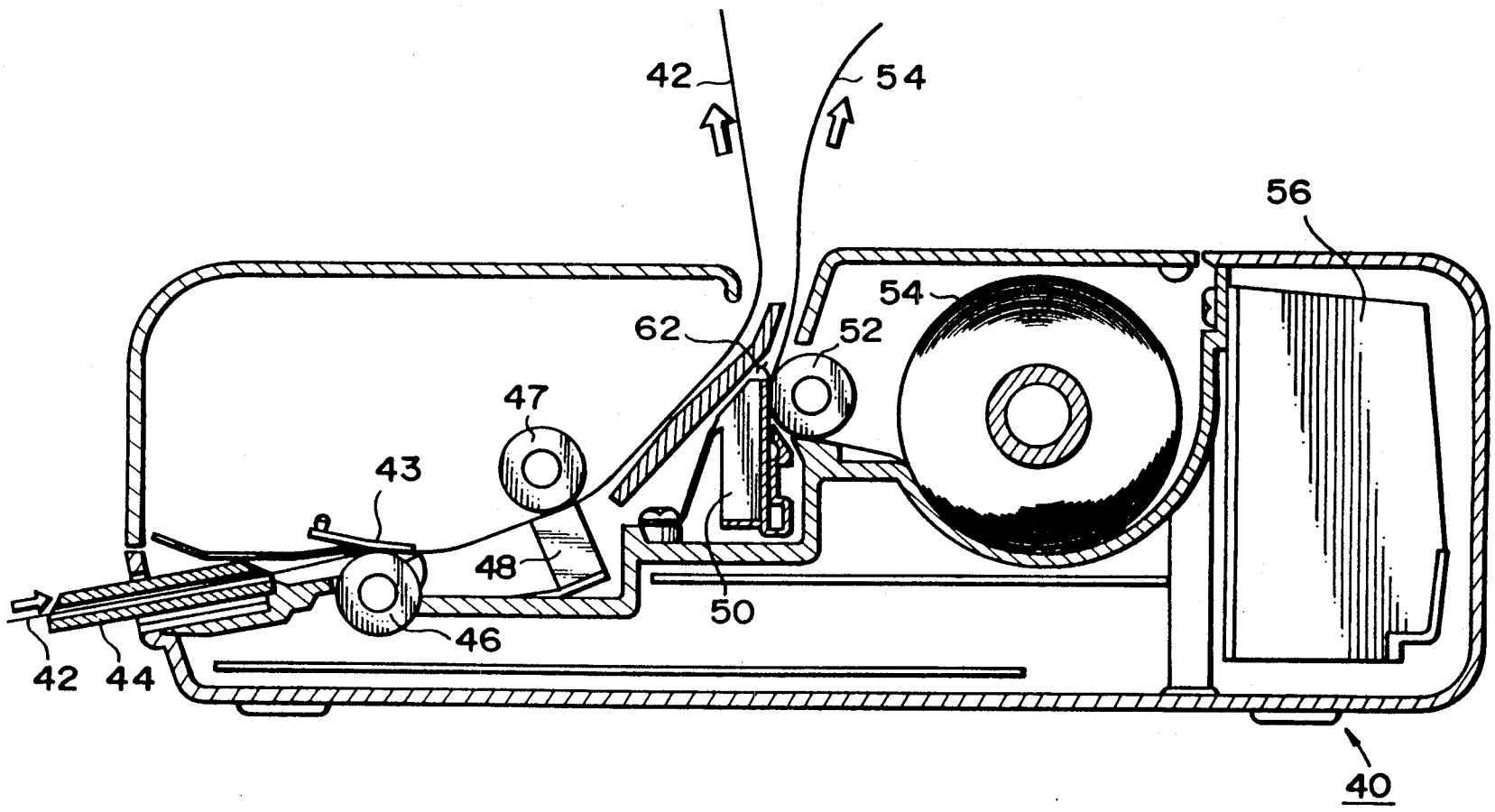
FIG. 5 is a printer including a thermal head according to the present invention.

In FIG. 5, there is shown a printer including a thermal head according to the present invention. In this case, the printer 40 includes an inlet 44 for inserting documents 42, a feed roller 46 for transferring the documents 42, an image sensor 48 for reading the contents of the documents 42, a printing part 50 including a thermal head according to the present invention for printing the contents of the documents 42, a record platen roller 52 mounted adjacent to the printing part 50 and a recording paper roll 54. This printer 40 is driven by using the electric energy supplied from a power source 56. Now, when the documents 42 are inserted into the inlet 44, the documents 42 are separated one by one by a separator 43 and are sent one by one to the image sensor 48. The image sensor 48 picks up a pattern of the surface of the document 42 and outputs electric signals to the printing part 50. The printing part 50 prints the pattern of the document on the recording paper 54 on the basis of the electric signals sent from the image sensor 48. The printer 40 uses an ink ribbon 62 in order to adapt printing onto a rough paper. Further, although FIG. 5 shows a copier facsimile machine including a reading device, the thermal head according to the present invention can be used for a printer having no reading device.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A thermal head for use in an electronic apparatus said thermal head comprising:

an insulating substrate;

a glaze layer formed on the insulating substrate;

a common electrode formed on the glaze layer;

at least two separate electrodes formed on the glaze layer, and a heating resistor extended between each of the separate electrodes and the common electrode, each of the separate electrodes having a thickness of at least 1.8 μm except near each heating resistor, wherein each of said separate electrodes includes a thin layer part having a length of approximately 1.0 to 2.0 mm from said heating resistor and a thickness of approximately 0.6 to 0.8 μm;

at least two semiconductor driver elements having an on-resistance of at most 7Ω for driving the heating resistors; and a protective film layer for covering the electrodes and the heating resistors.

2. The thermal head of claim 1, wherein each of said semiconductor driver elements possesses a large source area and a small on-resistance.

3. The thermal head of claim 1, wherein a part of each of said separate electrodes and a part of said common electrode near each heating resistor is formed by an organic gold paste and a remaining part of each of said separate electrodes and the rest of said common electrode other than said part near each heating resistor is formed by an inorganic gold paste.

4. The thermal head of claim 1, wherein each heating resistor has a width of approximately 240 μm and the common electrode includes a thin layer part having a length of approximately 0.5 mm from each heating resistor and a thickness of approximately 0.6 to 0.8 μm.

5. The thermal head of claim 4, wherein a part of each of said separate electrodes and a part of said common electrode between 1.0 to 2.0 mm from the heating resistor is formed by an organic gold paste and a remaining part of each of said separate electrodes and said common electrode except for said part near each heating resistor is formed by an inorganic gold paste.

6. A printer, comprising:

means for feeding a document;

means for supplying a paper to be printed upon;

an image sensor for picking up a pattern of the document and outputting electric signals;

a thermal head for printing on the paper based on the electric signals output from the image sensor;

the thermal head further including:

an insulating substrate;

a glaze layer formed on the insulating substrate;

a common electrode formed on the glaze layer;

at least two separate electrodes formed on the glaze layer and a heating resistor extended between each of the separate electrodes and the common electrode, each of said separate electrodes having a thickness of at least 1.8 μm except near each heating resistor, wherein each of said separate electrodes includes a thin layer part having a length of approximately 1.0 to 2.0 mm from said heating resistor and a thickness of approximately 0.6 to 0.8 μm;

at least two semiconductor drive elements having an on-resistance of at most 7Ω for driving the heating resistors; and a protecting film layer for covering the electrodes and the heating resistors.

7. The printer of claim 6, wherein each of said semiconductor driver elements of the thermal head possesses a large source area and a small on-resistance.

8. The printer of claim 6, wherein a part of each of said separate electrodes and a part of said common electrode near each heating resistor of the thermal head is formed by an organic gold paste and a remaining portion of each of said separate electrodes and said common electrode other than said part near each heating resistor is formed by an inorganic gold paste.

9. The printer of claim 6, wherein each of said separate electrodes of the thermal head includes a thin layer part having a length of approximately 1.0 to 2.0 mm from each heating resistor and a thickness of approximately 0.6 to 0.8 μm and a thick layer part having a thickness of approximately 1.8 μm, and each of said semiconductor driver elements of the thermal head possesses a large source area and a small on-resistance.

10. The printer of claim 6, wherein each of said separate electrodes of the thermal head includes a thin layer part having a length of approximately 1.0 to 2.0 mm from said heating resistor and a thickness of approximately 0.6 to 0.8 μm and a thick layer part having a thickness of approximately 1.8 μm, wherein each said heating resistor has a width of approximately 240 μm and the common electrode includes a thin layer part having a length of approximately 0.5 mm from each heating resistor and a thickness of approximately 0.6 to 0.8 μm.

11. The printer of claim 6, wherein each of said separate electrodes of the thermal head includes a thin layer part having a length of approximately 1.0 to 2.0 mm from said heating resistor and a thickness of approximately 0.6 to 0.8 μm and a thick layer part having a thickness of approximately 1.8 μm, wherein each heating resistor has a width of approximately 240 μm and the common electrode includes a thin layer part having a length of approximately 0.5 mm from each heating resistor and a thickness of approximately 0.6 to 0.8 μm, and wherein a part of each of said separate electrodes and said common electrode from 1.0 to 2.0 mm from each heating resistor is formed by an organic gold paste and a remaining portion of each of said separate electrodes and said common electrode is formed by an inorganic gold paste.

* * * * *